US007059915B1

(12) United States Patent
Schempp et al.

(10) Patent No.: US 7,059,915 B1
(45) Date of Patent: Jun. 13, 2006

(54) PANEL MOUNTED MODULAR JACK TERMINATED TO A CIRCUIT BOARD

(75) Inventors: Otto Schempp, Bad Rappenau (DE); Dušan Ondrej, Heilbronn (DE); Michael Heim, Leingarten (DE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/168,026

(22) Filed: Jun. 28, 2005

(51) Int. Cl.
*H01R 24/00* (2006.01)

(52) U.S. Cl. ..... 439/676; 439/557

(58) Field of Classification Search ..... 439/676, 439/557
See application file for complete search history.

(56) References Cited

U.S. PATENT DOCUMENTS 4,602,842 A * 7/1986 Free et al. ..... 439/633
4,647,136 A 3/1987 Kinoshita et al.
5,178,554 A 1/1993 Siemon et al.
5,310,360 A 5/1994 Peterson
5,769,668 A 6/1998 Tondreault
6,210,217 B1 * 4/2001 Ping ..... 439/557
6,325,674 B1 12/2001 Oliphant et al.
6,338,656 B1 * 1/2002 Oliphant et al. ..... 439/676
6,394,850 B1 5/2002 Oliphant et al.
6,488,543 B1 12/2002 Oliphant et al.
6,599,152 B1 7/2003 Oliphant et al.

* cited by examiner

*Primary Examiner*—Ross Gushi
(74) *Attorney, Agent, or Firm*—Stephen Z. Weiss

(57) ABSTRACT

A modular jack is mountable in a panel and to a circuit board. The modular jack includes a non-conductive housing having a front mating end and a rear terminating end. The front end has a receptacle for receiving a mating jack plug. The rear end has a slot for receiving an edge of the printed circuit board. A plurality of conductive terminals are mounted in the housing and have contact portions projecting into the receptacle for engaging contacts on the mating jack plug. The terminals have tail portions exposed at the slot for engaging circuit traces on the printed circuit board. Interengaging retaining components are provided between the housing and the panel to hold the modular jack in an opening in the panel.

12 Claims, 6 Drawing Sheets

PANEL MOUNTED MODULAR JACK TERMINATED TO A CIRCUIT BOARD

FIELD OF THE INVENTION

This invention generally relates to the art of electrical connectors and, particularly, to a modular jack which is mountable in an opening in a panel and which is terminated to a printed circuit board.

BACKGROUND OF THE INVENTION

Modular jack assemblies are used in telecommunications equipment for mating with telephone-type modular jack plugs to transmit electrical signals therethrough. A typical modular jack includes a non-conductive housing having a receptacle for receiving the modular jack plug. A plurality of conductive terminals are mounted in the housing, with contact arms cantilevered into the receptacle. A modular jack often is mounted within a panel of a wide range of electronic apparatus including computer equipment and the like. The modular jack plug is inserted into the receptacle from the front of the panel, and the modular jack may be terminated to a printed circuit board behind the panel.

Board-mounted modular jacks of the prior art typically are terminated to printed circuit boards by soldering tail portions of the jack terminals to appropriate circuit traces on the printed circuit board. This typically is done prior to installation of the modular jack in an electronic apparatus such as prior to mounting the jack in an opening in a panel. There is a need for some type of system for terminating such board mounted modular jacks without using soldering techniques and the inherent problems thereof, such as creating excessive heat, etc. The present invention is directed to satisfying that need by providing a modular jack which is easily snap-locked in a panel and which can receive a printed circuit board for termination thereto without soldering the jack terminals to the circuit traces on the board.

SUMMARY OF THE INVENTION

An object, therefore, of the invention is to provide a new and improved modular jack which is mountable in a panel and to a printed circuit board.

In the exemplary embodiment of the invention, the modular jack includes a non-conductive housing having a front mating end and a rear terminating end The front end has a receptacle for receiving a mating jack plug. The rear end has a slot for receiving an edge of the printed circuit board. A plurality of conductive terminals are mounted in the housing and have contact portions projecting into the receptacle for engaging contacts on the mating jack plug. The terminals have tail portions exposed at the slot for engaging circuit traces on the printed circuit board. Interengaging retaining means are provided between the housing and the panel to hold the modular jack in an opening in the panel.

According to one aspect of the invention, the housing includes a projection insertable into a notch in the edge of the printed circuit board when the modular jack is mounted in a panel. This properly aligns the housing and the board and ensures proper alignment of the tail portions of the terminals with the circuit traces on the board. In the preferred embodiment, the projection comprises a rib located in the slot in the housing.

According to another aspect of the invention, the housing includes a projection insertable into an opening in a wall of the panel which is bent back over the housing. In the preferred embodiment of the invention, the projection comprises a boss insertable into a notch in a rear edge of the bent back wall of the panel. A front flange of the housing bears against the front of the panel and is snapped through an opening in the panel. Therefore, the modular jack housing is snap-locked in the panel between the flange and the boss.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
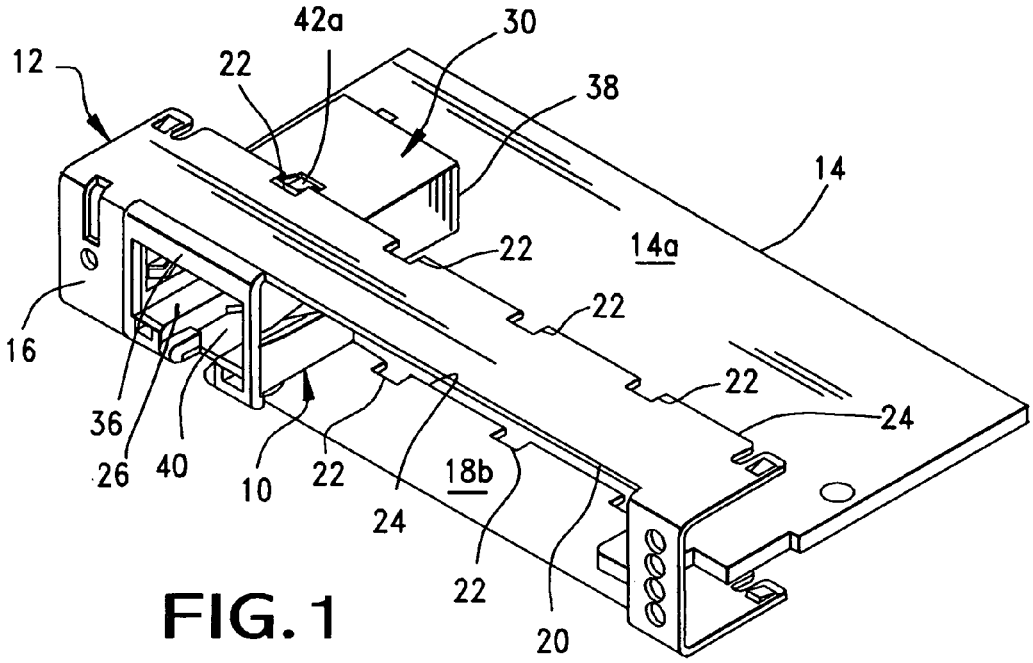
FIG. 1 is a front perspective view of a system according to the invention wherein a modular jack is mounted in an opening in a panel and which is terminated to a printed circuit board.
Figure 2:
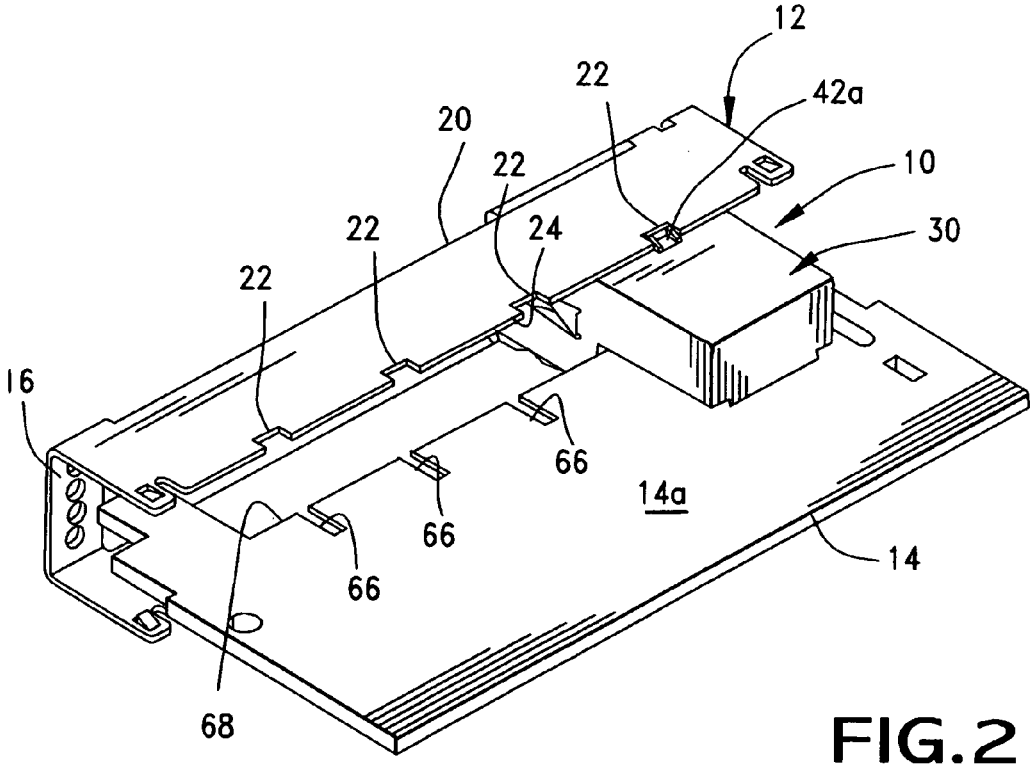
FIG. 2 is a rear perspective view of the depiction in FIG. 1.

Referring to the drawings in greater detail, and first to FIGS. 1 and 2, the invention is embodied in a modular jack, generally designated 10, which is mountable in a panel, generally designated 12, and which is terminated to a printed circuit board 14 having appropriate circuit traces (not shown) on a top surface 14*a* thereof. Before proceeding, it should be understood that such terms as "top", "bottom", "vertical" and the like herein and in the claims hereof are used only to provide a clear and concise understanding of the invention as viewed in the orientations of the drawings. The modular jack and the system within which it is used, obviously, is omni-directional in use and function.

In addition, the term "panel" herein and in the claims hereof is not intended to be limited in any way to a planar-type panel. The panel can include a U-shaped rail portion 12 alone or in combination with a support structure (not shown). The modular jack is mountable within an opening in a wide arrange of structures, from a planar panel to a three-dimensional chassis. For instance, it can be seen in FIGS. 1 and 2 that panel 12 is generally U-shaped and includes a front wall 16 and a pair of side walls 18*a* and 18*b*.

In the depiction of the drawings, side wall 18*a* is a top wall and side wall 18*b* is a bottom wall. The panel or chassis may be stamped and formed of sheet metal material, and walls 18*a* and 18*b* are bent back over the top and bottom of the modular jack. The panel is elongated, and an elongated opening 20 extends longitudinally of front wall 16 to accommodate a plurality of modular jacks, such as the four jacks shown in FIG. 3. A plurality of notches 22 are stamped out of the rear edges 24 of the rearwardly bent walls 18*a* and 18*b*. Also stamped from the rearwardly bent walls 18*a* and 18*b* are flexible locking fingers 18*c* and 18*d* respectively.

Figure 4:
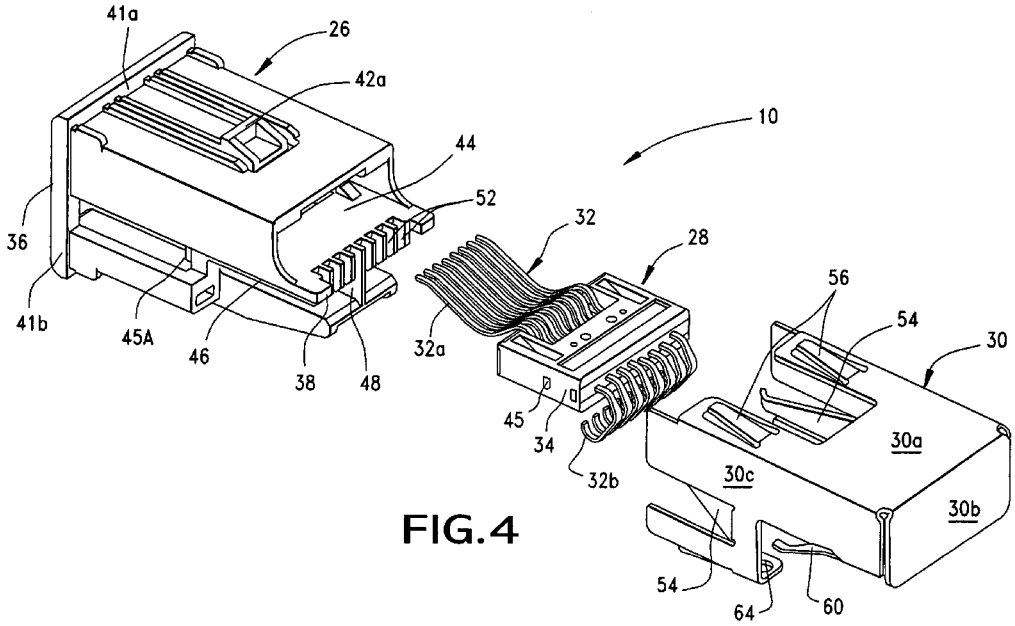
FIG. 4 is an exploded, rear perspective view of the modular jack of the invention.

Referring to FIG. 4, each modular jack includes three principal components, namely: a non-conductive housing, generally designated 26; a terminal module, generally designated 28; and an outer metal shell, generally designated 30. Housing 26 is a one-piece structure unitarily molded of non-conductive material such as plastic or the like. Terminal module 28 includes a plurality of conductive terminals, generally designated 32, mounted in a non-conductive insert 34. Metal shell 30 is a one-piece structure stamped and formed of conductive sheet metal material.

Figure 5:
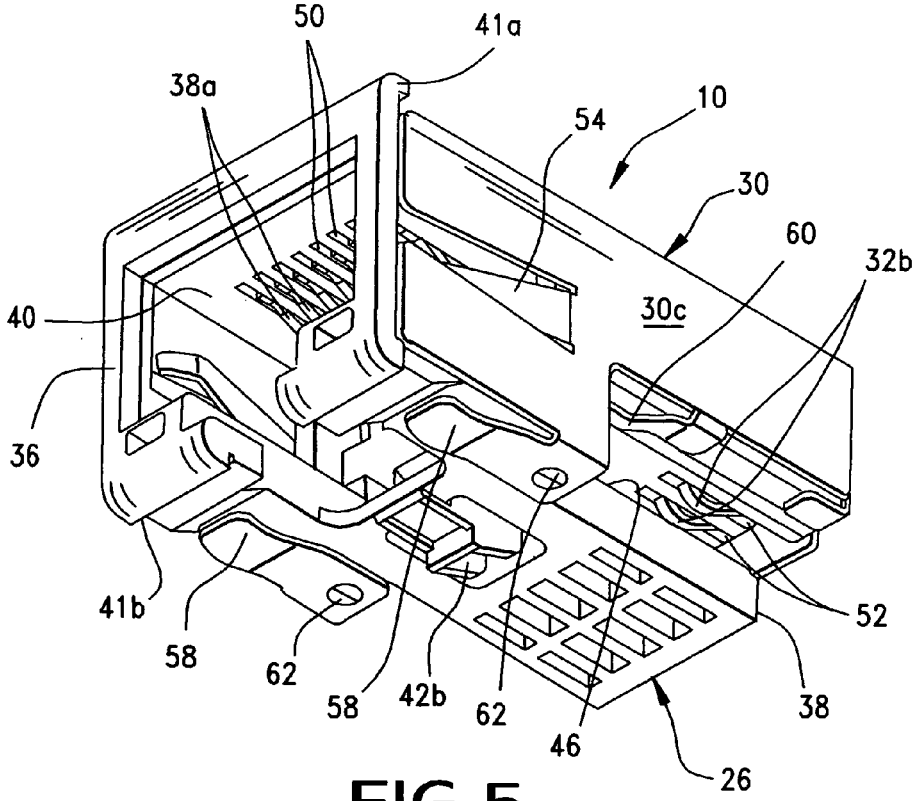
FIG. 5 is a front, bottom perspective view of the modular jack in assembled condition.

More particularly, referring to FIG. 5 in conjunction with FIG. 4, non-conductive housing 26 includes a front mating end 36 and a rear terminating end 38. The front end has a receptacle 40 for receiving a mating jack plug. Top and bottom flanges 41*a* and 41*b*, respectively, project upwardly from the housing across the front end thereof. Top and bottom retaining bosses 42*a* and 42*b*, respectively, project upwardly from the housing generally centrally thereof. A cavity 44 (FIG. 4) is formed in the housing and opens to the rear thereof for receiving terminal module 28. The terminal module is retained in housing 26 by means of latch bosses 45 on the non-conductive insert engaging behind latch shoulders 45A of the housing. A rearwardly opening slot 46 is formed in the housing for receiving printed circuit board 14, as will be seen hereinafter. A projection or rib 48 (FIG. 4) extends front-to-rear within slot 46.

Terminals 32 of terminal module 28 may be "stitched" into non-conductive insert 34, or the terminals may be insert molded within the insert, as the insert is fabricated of plastic material molded about intermediate portions of the terminals. The terminals have elongated, curved contact portions 32*a* which are cantilevered into receptacle 40 for engaging appropriate contacts on the mating jack plug. The terminals have rounded tail portions 32*b* at the rear ends thereof and which are bent downwardly of non-conductive insert 34. As can be seen in FIG. 5, tail portions 34*b* are exposed within slot 46 for engaging circuit traces on surface 14*a* of printed circuit board 14. Contact portions 32*a* are maintained in proper spacing and alignment by a plurality of grooves 50 formed in housing 26 within receptacle 40. Tail portions 32 are maintained in proper spacing and alignment by a plurality of notches 52 formed at the rear of the housing.

Metal shell 30 of modular jack 10 substantially surrounds a major portion of non-conductive housing 26, but is substantially open at the bottom of the shell as seen in FIG. 5. In particular, the shell has a top wall 30*a*, a rear wall 30*b* and side walls 30*c*. A pair of spring arms 54 are stamped and formed out of side walls 30*c* for engaging an appropriate metal shell or other ground member on the mating jack plug. A pair of spring arms 56 (FIG. 4) are stamped and formed out of top wall 30*a* for engaging the underside of top wall 18*a* of panel 12. A pair of spring arms 58 (FIG. 5) are formed along the bottom edges of side walls 30*c* for engaging the top side of bottom wall 18*b* of panel 12. Similarly, a pair of spring arms 60 are stamped and formed along another bottom edge of side walls 30*c*, above slot 46, for engaging appropriate ground traces on printed circuit board 14. Therefore, the shell provides a commoning ground between the mating jack plug, panel 12 and circuit board 14. The shell may be secured to the housing by appropriate fasteners 62 (FIG. 5), such as self-tapping screws extending through holes 64 into the housing or as projections on the housing extending through holes 64 in the shell where the portion of the shell having the hole 64 can slide over the projection until the projection aligns with and snaps into the hole when the shell is in final alignment with the housing.

Figure 6:
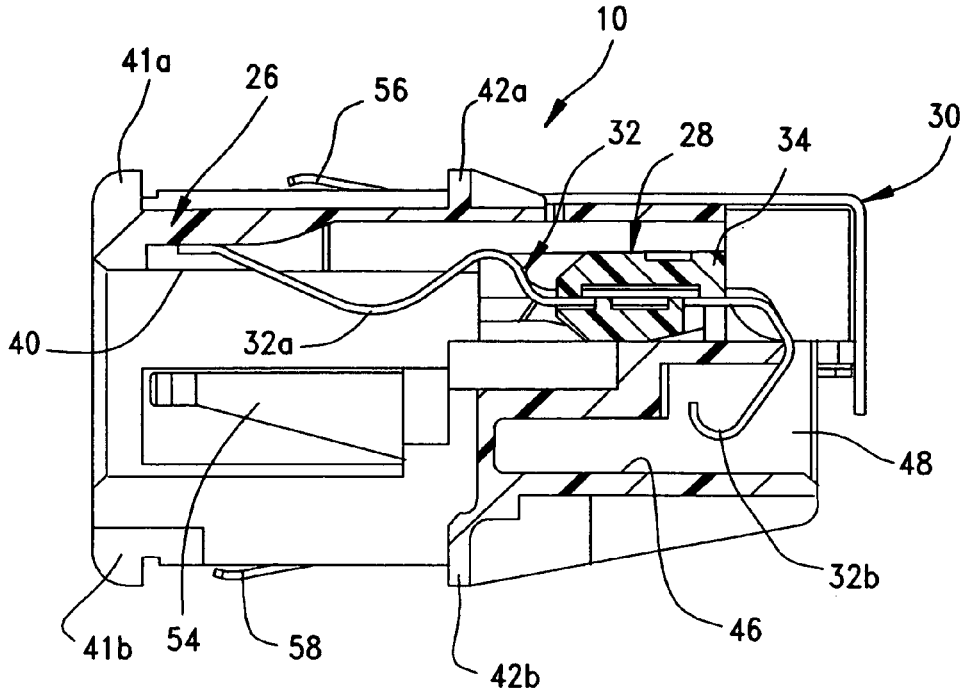
FIG. 6 is a front-to-rear vertical section of the modular jack in FIG. 5.

FIG. 6 shows a front-to-rear section through modular jack 10. It can be seen how contact portions 32*a* of terminals 32 are exposed within receptacle 40 for engaging the contacts of the mating jack plug inserted into the receptacle. Spring arms 54 of metal shell 30 also are exposed within receptacle 40. It can be seen how tail portions 32*b* of the terminals project downwardly into slot 46 for engaging the circuit traces on printed circuit board 14. FIG. 6 also shows how spring arms 56 and 58 project upwardly and downwardly, respectively, for engaging the rearwardly extending side walls 18*a* and 18*b* (FIG. 1) of panel 12.

Figure 7:
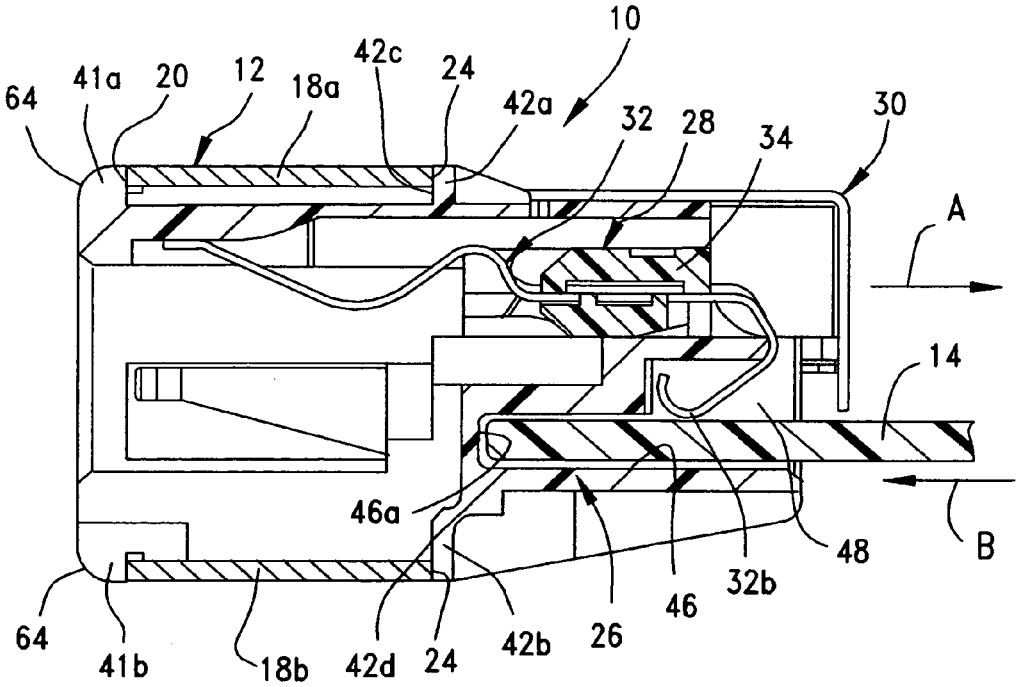
FIG. 7 is a view similar to that of FIG. 6, with the modular jack mounted in the panel and to the printed circuit board.

FIG. 7 shows modular jack 10 mounted within opening 20 of panel 12 and receiving printed circuit board 14. bosses 42*a* and 42*b* are angled so that during insertion of the mod jack into the panel 12 in the direction of arrow "A" boss 42*a* will deflect until the jack is fully inserted at which time the straight edge 42*c* will snap into abutting relationship with rear edge 24 of the top wall 18*a* of the panel. During insertion the bottom wall 18*b* of the panel will flex over angled portion of boss 42*b* until the jack is fully inserted at which time the rear edge 24 of the bottom wall will snap into abutting relationship with the straight edge 42*d*. When the modular jack snaps into position, flanges 41*a* and 41*b* abut against the front edge of opening 20. Bosses 42*a* and 42*b* abut against rear edges 24 of top and bottom walls 18*a* and 18*b*, respectively, of the panel. Therefore, the top and bottom side walls of the panel are sandwiched between flanges 41*a*/41*b* and bosses 42*a*/42*b* of housing 26 of the modular jack.

Figure 3:
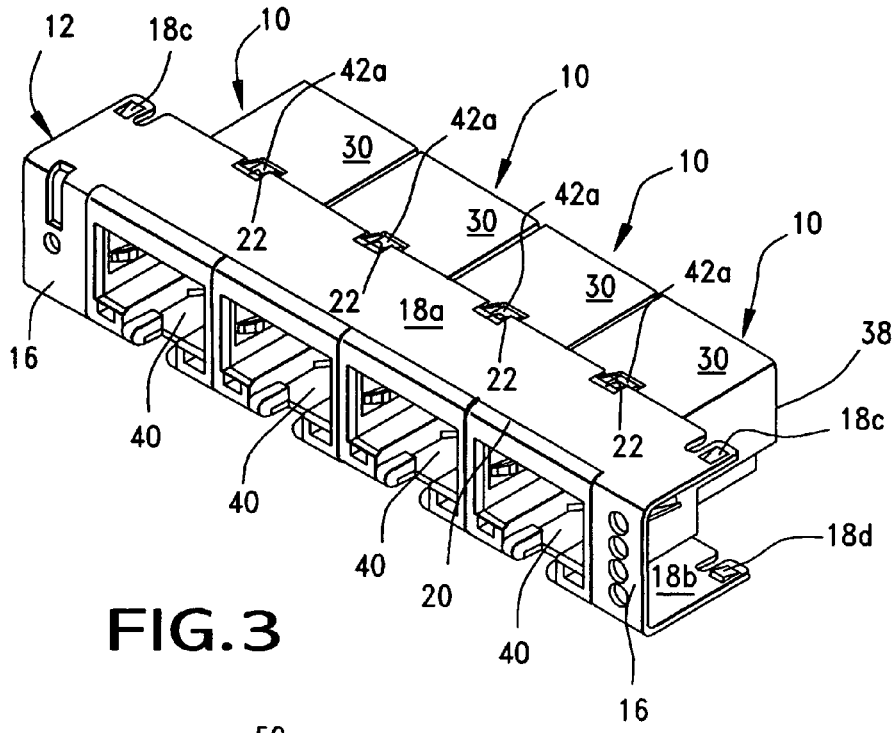
FIG. 3 is a view similar to that of FIG. 1, but showing four modular jacks mounted in the panel.

Still referring to FIG. 7, as the modular jack is inserted into the panel in the direction of arrow "A", a leading edge of the board bottoms out at an inner end 46*a* of the slot and tail portions 32*b* of terminals 32 are spring loaded against appropriate circuit traces on top of the printed circuit board. Means are provided for aligning the modular jack and its terminals 32 with the circuit board and its circuit traces. This means is provided by rib 48 (FIGS. 4 and 7) interengaging within one of a plurality of notches 66 (FIG. 2) cut-out in an edge 68 of printed circuit board 14. The notch for the modular jack 10 shown in FIG. 2 is not visible in the drawings. However, circuit board 14 will have four notches 66 to accommodate four modular jacks 10 as can be seen in FIG. 3.

Figure 8:
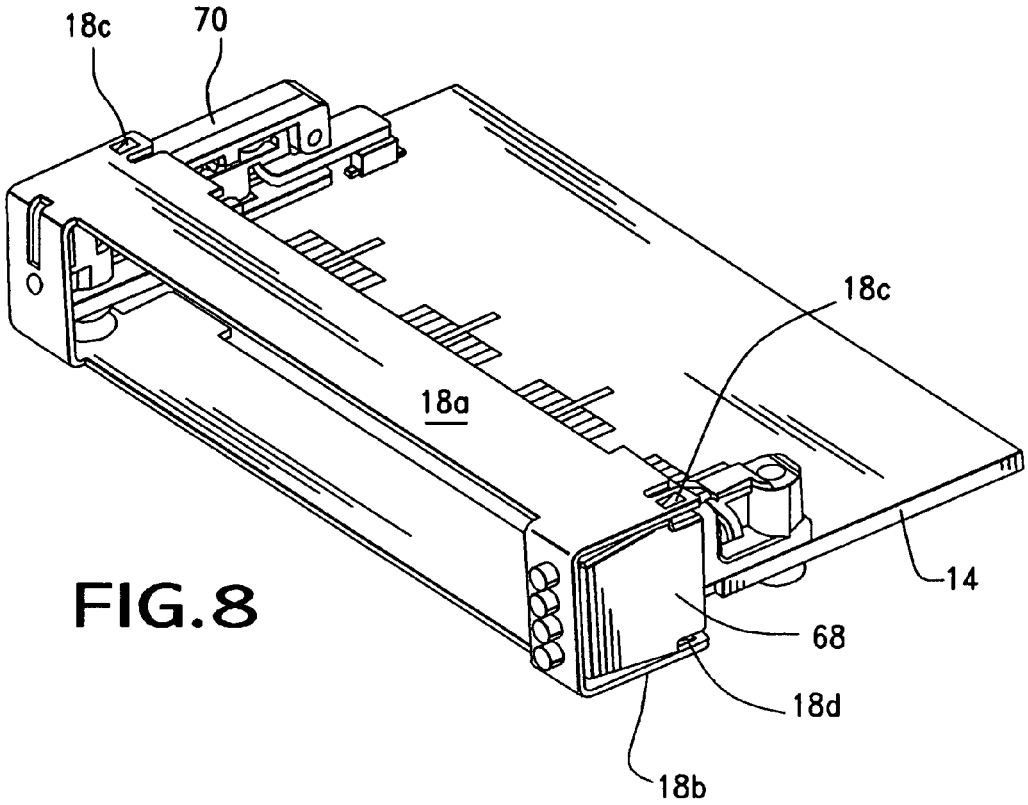
FIG. 8 is a view similar to FIG. 1 but including two mounting brackets and not including any mod jack.
Figure 9:
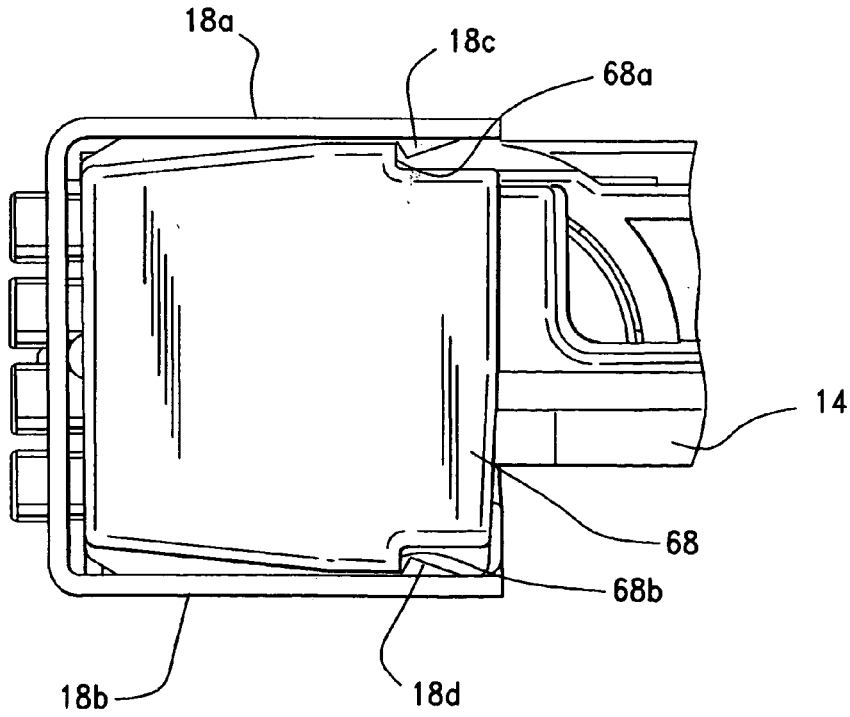
FIG. 9 is a partial side view of the depiction in FIG. 8.

FIGS. 8 and 9 show a pair of mounting brackets 68 and 79, which are fixed to the printed circuit board 14. Slotted shoulders 68*a* and 68*b* are formed in the top and bottom walls of bracket 68. Similarly slotted shoulders (not shown) are in bracket 70. The U-shaped panel 18 is held to the printed circuit board 14 by the locking fingers 18*c* and 18*d* snapping into engagement with the respective slotted shoulders formed in both brackets 68, 70.

As an alternative configuration the modular jack can first be inserted into the rail of the front panel. Thereafter the rail/jack assembly can be fixed to the panel support structure or the printed circuit board to hold the rail/jack assembly in position so that the jack terminals properly engage the traces on the printed circuit board.

Figure 10:
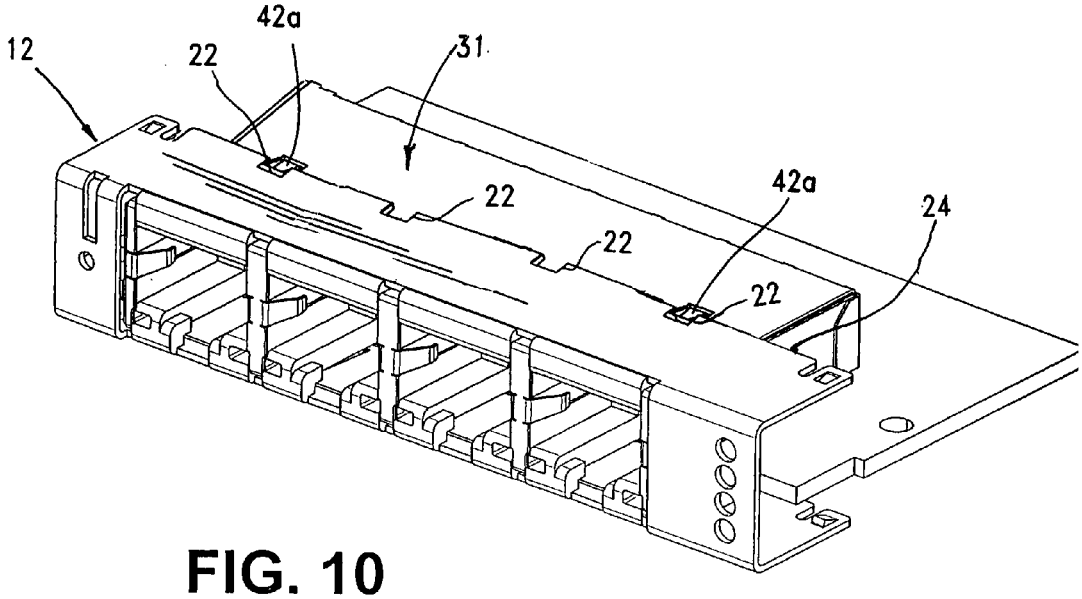
FIG. 10 is a front perspective view of a system according to a different embodiment of the invention.
Figure 11:
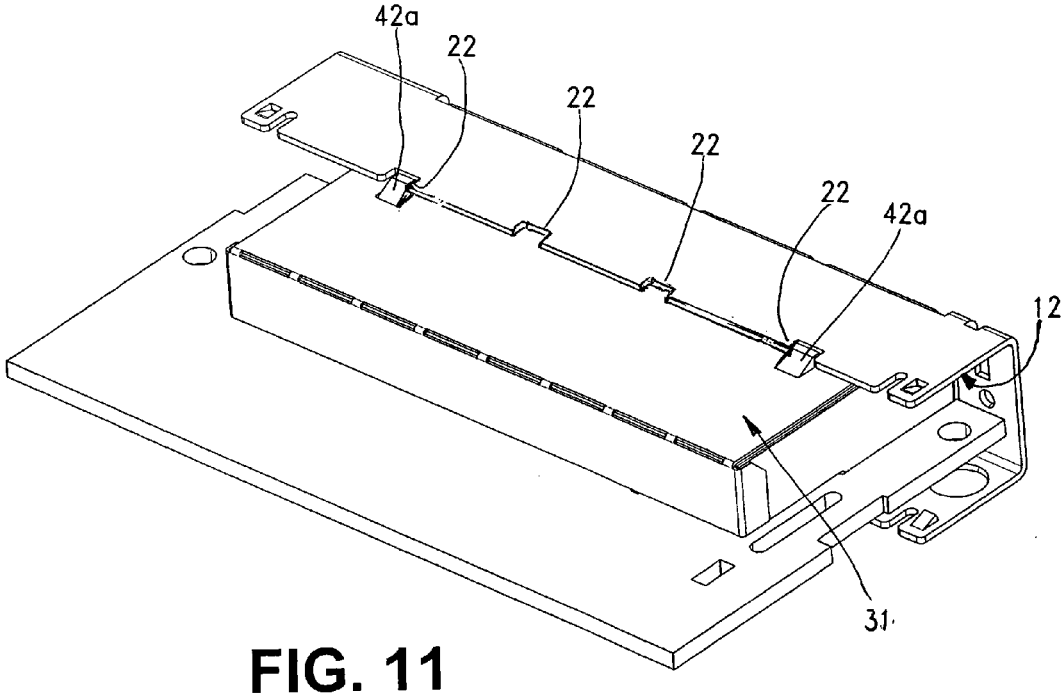
FIG. 11 is a rear perspective view of the depiction in FIG. 10.

FIGS. 10 and 11 show a further alternate embodiment of the mod jack configuration, which is inserted in the panel. Instead of a mod jack housing 26 containing just one receptacle 40, a ganged mod jack housing 27 containing four receptacles 40 is used. One metal shell 31 substantially surrounds a major portion of the non-conductive housing 27. Two bosses 42*a* on the top of the housing at each edge and similar bosses (not shown) on the bottom of the housing engage corresponding notches 22 in the top and bottom walls of the panel 12 with some of the notches not being used. It should be noted that one elongated notch or just merely an edge of the top and bottom walls of the panel can hold the mod jack housings 26 and 27 in the panel. Providing a ganged mod jack will reduce the cost of the connector by requiring less labor in installation and less expense in manufacturing with only one shell.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A modular jack mountable in an elongated opening in a front wall of a panel for receiving a plurality of said modular jacks said panel having sidewalls bent from the front wall and to a printed circuit board having a plurality of notches in an edge, comprising:

a non-conductive housing having a front mating end and a rear terminating end, the front end having a receptacle for receiving a mating jack plug, and the rear end having a slot for receiving an edge of the printed circuit board, said rear end insertable into the elongated opening;

a plurality of conductive terminals mounted in the housing and having contact portions projecting into said receptacle for engaging contacts on the mating jack plug and tail portions exposed at said slot for engaging circuit traces on the printed circuit board;

interengaging retaining means between the housing and the panel to hold each of the plurality of modular jacks in a respective position in the elongated opening in the panel said interengaging means including a boss insertable against a rear edge of said bent side walls of the panel; and positioning means on one side of each housing for locating the plurality of modular jacks at said respective position along the elongated opening, the positioning means including a projecting rib insertable into one of said board notches when the modular jack is mounted in the panel to properly align the housing and the board and ensure proper alignment of the tail portions of the terminals with the circuit traces on the board and at least one of said interengaging retaining means on a side of the housing opposite said one side upon which said positioning means is located.

2. A modular jack mountable in a front wall of a panel and to a printed circuit board, comprising:

a non-conductive housing having a front mating end insertable into an opening in the front wall of the panel with side walls of the panel bent from the front wall over the housing and a rear terminating end, the front end having a receptacle for receiving a mating jack plug, and the rear end having a slot for receiving an edge of the printed circuit board;

a conductive shell located over the non-conductive housing with flexible arm and engageable with one or more of the bent back sidewalls of the panel when the modular jack is mounted in the panel;

a plurality of conductive terminals mounted in the housing and having contact portions projecting into said receptacle for engaging contacts on the mating jack plug and tail portions exposed at said slot for engaging circuit traces on the printed circuit board; and said housing including a projecting rib insertable into a notch in the edge of the printed circuit board when the modular jack is mounted in the panel to properly align the housing and the board and ensure proper alignment of the tail portions of the terminals with the circuit traces on the board.

3. The modular jack of claim 2 wherein said opening in the panel is elongated for receiving a plurality of modular jacks.

4. The modular jack of claim 2 wherein said rear terminal end comprises a boss insertable against a rear edge of said bent back side wall of the panel.

5. The modular jack of claim 2 wherein the rear terminating end comprises a boss insertable into a notch at the rear edge of said bent back side wall of the panel.

6. A system for mounting a modular jack in a panel, comprising:

a panel having a front wall with an elongated opening for receiving a plurality of modular jacks and side walls extending rearwardly from edge of the opening to a rear edge of the side wall;

a modular jack housing having a front mating end generally at said opening in the panel and a rear end, the front end having a receptacle for receiving a mating jack plug;

a plurality of conductive terminals mounted in the housing and having contact portions projecting into said receptacle for engaging contacts on the mating jack plug; and interengaging retaining means between the housing and the panel to hold the modular jack in the opening in the panel, including a flange projecting outwardly from the housing at the front end thereof for abutting the panel in front of said opening, the rear end of the housing including a boss insertable against a rear edge of said rearwardly extending side walls of the panel and further including positioning means for locating the modular jack at a proper position along the elongated opening.

7. The system of claim 6 wherein the rear end of the housing includes a slot for receiving an edge of a printed circuit board, and the terminals include tail portions exposed at the slot for engaging circuit traces on the printed circuit board, and the panel including at least one rail having said panel opening and a support structure with interengaging locking means between the rail and the support structure to hold the rail to the structure and to hold the terminal tail portions in engagement with the circuit board traces.

8. The system of claim 6 further including a conductive shell located over the housing with flexible arms engageable with one of more of the panel side walls when the modular jack is mounted in the panel.

9. The system of claim 6 wherein the rear end of the housing includes a slot for receiving an edge of a printed circuit board, and the terminals include tail portions exposed at the slot for engaging circuit traces on the printed circuit board, and the panel including at least one rail having said panel opening and interengaging locking means between the rail and the printed circuit board to hold the rail to the printed circuit board and to hold the terminal tail portions in engagement with the printed circuit board traces.

10. The system of claim 6 wherein said positioning means includes a locating projection on the housing insertable into a notch in the edge of the printed circuit board when the modular jack is mounted in the panel to properly align the housing and the board and to ensure proper alignment of the tail portions of the terminals with the circuit traces on the board.

11. The system of claim 10 wherein said locating projection comprises a rib located in said slot.

12. A modular jack mountable in a front wall of a panel and to a printed circuit board, comprising:

a non-conductive housing having a front mating end and a rear terminating end, the front end having a receptacle for receiving a mating jack plug, and the rear end having a slot for receiving an edge of the printed circuit board and insertable into an opening in the front wall of the panel with side walls of the panel bent from the front wall over the housing;

a plurality of conductive terminals mounted in the housing and having contact portions projecting into said receptacle for engaging contacts on the mating jack plug and tail portions exposed at said slot for engaging circuit traces on the printed circuit board;

interengaging retaining means between the housing and the panel to hold the modular jack in an opening in the panel; and a conductive shell located over the non-conductive housing with flexible arms engageable with one or more of the bent back side walls of the panel when the modular jack is mounted in the panel.

* * * * *